US005820393A

United States Patent [19]

Edgley et al.

[11] Patent Number: 5,820,393

[45] Date of Patent: Oct. 13, 1998

[54] BOARD MOUNTED ELECTRICAL CONNECTOR WITH MULTI-FUNCTION BOARD LOCK

[75] Inventors: Richard R. Edgley, Elmhurst; Charlie Manlapaz, Oak Lawn; Augusto P. Panella, Bolingbrook; Nels Pearson, Deerfield, all of Ill.

[73] Assignee: Molex Incorporation, Lisle, Ill.

[21] Appl. No.: 774,485

[22] Filed: Dec. 30, 1996

[51] Int. Cl.[6] ..... H01R 13/53

[52] U.S. Cl. ..... 439/181; 439/381; 439/567

[58] Field of Search ..... 439/79, 608, 181, 439/567, 571, 572, 381

[56] References Cited

U.S. PATENT DOCUMENTS

| | | | |
|---|---|---|---|
| Re. 32,502 | 9/1987 | Kumar | 439/92 |
| 4,601,527 | 7/1986 | Lemke | 339/14 R |
| 4,639,066 | 1/1987 | Shimamiya et al. | 339/132 |
| 4,681,389 | 7/1987 | Nakazawa et al. | 439/557 |
| 4,729,752 | 3/1988 | Dawson, Jr. et al. | 439/620 |
| 4,828,506 | 5/1989 | Tuckwood | 439/181 |
| 4,842,529 | 6/1989 | Frantz et al. | 439/95 |
| 5,096,436 | 3/1992 | Noschese | 29/876 |
| 5,147,220 | 9/1992 | Lybrand | 439/567 |
| 5,161,991 | 11/1992 | Bauer | 439/181 |
| 5,190,472 | 3/1993 | Voltz et al. | 439/579 |
| 5,215,478 | 6/1993 | Briones | 439/620 |
| 5,419,713 | 5/1995 | Northey | 439/329 |
| 5,599,207 | 2/1997 | Lai | 439/567 |
| 5,674,083 | 10/1997 | Whiteman, Jr. et al. | 439/181 |

FOREIGN PATENT DOCUMENTS

| | | | |
|---|---|---|---|
| 664056 B1 | 5/1996 | European Pat. Off. | H01R 13/719 |

*Primary Examiner*—Gary F. Paumen
*Attorney, Agent, or Firm*—Stephen Z. Weiss

[57] ABSTRACT

An electrical connector is disclosed for mounting on a printed circuit board. The connector includes a dielectric housing having a mating portion. A plurality of terminals are mounted in the housing and include tail portions extending therefrom. A conductive shell is mounted on the housing at least about the mating portion thereof. A conductive electrostatic discharge plate is mounted about the tail portions creating a predetermined spark gap between the plate and the tail portions to pass a current when a predetermined voltage exists between the plate and the tail portions. A conductive board lock holds the connector to the printed circuit board and is adapted for connection to a ground circuit on the board. The board lock engages the conductive shell and the conductive electrostatic discharge plate to common the shell and the plate with the ground circuit on the printed circuit board.

17 Claims, 4 Drawing Sheets

BOARD MOUNTED ELECTRICAL CONNECTOR WITH MULTI-FUNCTION BOARD LOCK

FIELD OF THE INVENTION

This invention generally relates to the art of electrical connectors and, particularly, to a board mounted electrical connector which includes a board lock that performs a multitude of functions.

BACKGROUND OF THE INVENTION

Generally, a typical electrical connector includes a dielectric or insulating housing which mounts a plurality of conductive terminals or contacts. The terminals may be adapted for mating with the terminals of a complementary connector or other connecting device. The terminals are terminated to discrete electrical wires or to conductive circuit traces on a printed circuit board. In the latter instance, the terminals typically have solder tails projecting from the connector housing for solder connection to the circuit traces on the board. Some connectors also include a conductive (usually metal) shell which includes a portion surrounding the mating portion of the connector for shielding the mating interface.

In circuit board mounted electrical connectors, some form of means typically is provided for holding the connector to the board, at least securing the connector during a soldering operation. That means may range from mounting posts or pegs integrally molded with the connector housing to discrete or independent mounting members or board locks. The posts, pegs or board locks are inserted into locating holes in the printed circuit board. The metal shell or shield of the connector also requires some form of means for connecting the conductive shield to a ground circuit trace on the printed circuit board. In some applications, the connector may include an electrostatic discharge plate which creates a predetermined spark gap between the plate and the solder tails of the terminals to pass a current when a predetermined voltage exists between the plate and the terminals. This member also requires some form of means for grounding the plate to a ground circuit on the printed circuit board. A problem with these types of connectors is that all of the mentioned elements that must be connected to circuits on the printed circuit board require valuable "real estate" in providing the interconnections. Still further, it is typical to provide such board mounted connectors with latches to latch the connector to its mating connector. The latches, themselves, increase the overall envelope or size of the connector assembly which, in turn, takes up still further real estate on the board. The present invention is directed to providing a circuit board mounted electrical connector which has a board lock that performs a multitude of functions in a single member and greatly reduces the amount of space on a printed circuit board for mounting the connector.

SUMMARY OF THE INVENTION

An object, therefore, of the invention is to provide an electrical connector for mounting on a printed circuit board, with the connector including a new and improved board lock means.

In the exemplary embodiment of the invention, the connector includes a dielectric housing having a front mating face and an opposite face. A plurality of terminals are mounted in the housing and include solder tails extending from the opposite face for connection to circuit traces on the printed circuit board. A conductive shell is mounted on the housing generally about the mating face. A terminal tail aligner is mounted to the housing and has a plurality of passages for receiving and aligning the solder tails of the terminals. A conductive electrostatic discharge plate is mounted on the tail aligner and creates a predetermined gap between the plate and the solder tails to pass a current when a predetermined voltage exists between the plate and the terminals. A conductive board lock is secured to the housing for holding the connector to the printed circuit board. The board lock is adapted for connection to a ground circuit on the printed circuit board. The board lock engages the conductive shell and the conductive electrostatic discharge plate to ground the shell and the plate to the ground circuit on the printed circuit board.

As disclosed herein, the conductive board lock includes latch means adapted for latching the connector to an appropriate complementary mating connector. The conductive board lock passes through aligned apertures in the housing, the shell and the electrostatic discharge plate, all the apertures being structured to establish an interference fit with the board lock. The conductive board lock is elongated and includes a board mounting end for locking to the printed circuit board and a latch end for latching to the complementary mating connector.

From the foregoing, it can be understood that a single board lock member performs a multitude of functions, including: (a) mounting the connector to the printed circuit board; (b) grounding the conductive shell to a ground circuit on the board; (c) grounding the conductive electrostatic discharge plate to a ground circuit on the board and (d) latching the connector to the complementary mating connector. A single member performs four discrete and important functions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
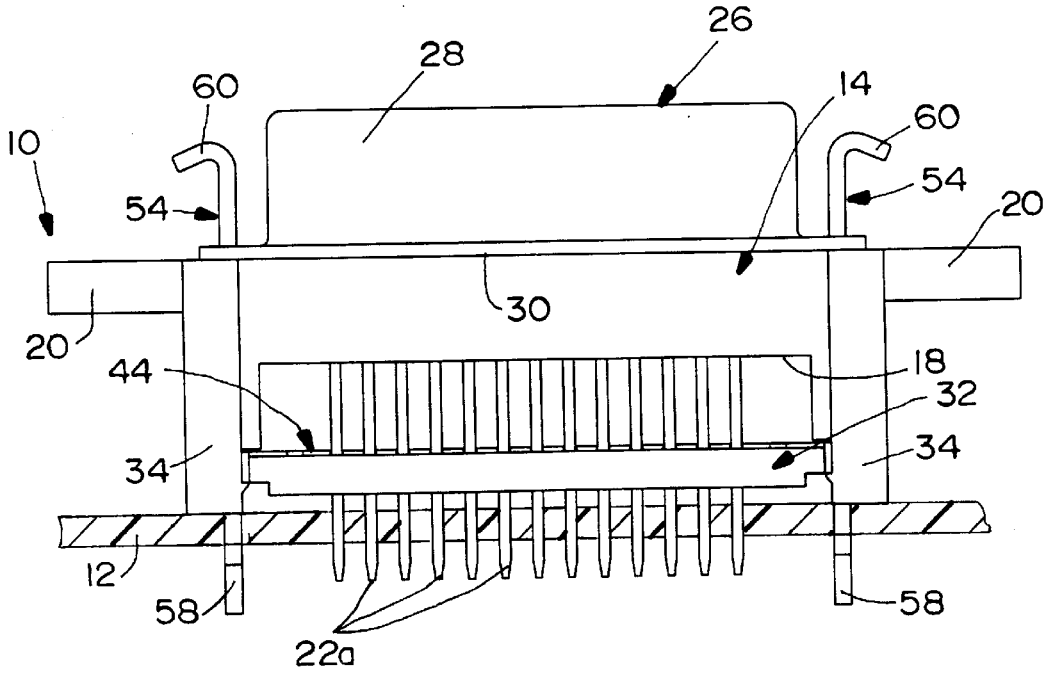
FIG. 1 is a side elevational view of an electrical connector embodying the concepts of the invention.

Referring to the drawings in greater detail, and first to FIGS. 1–4, the invention is embodied in an electrical connector, generally designated 10, for mounting on a printed circuit board 12 (FIG. 1). The connector includes a dielectric housing, generally designated 14, which includes a front mating face 16 and an opposite face 18. The housing and, therefore, the connector is elongated and includes a pair of end wings 20.

A plurality of terminals 22 are mounted in connector housing 14 on opposite sides of an elongated slot 24 which receives a mating portion and mating terminals of an appropriate complementary mating connector (not shown). The terminals have solder tails 22*a* which project in four rows from opposite face 18 of the housing. The solder tails extend through appropriate holes in printed circuit board 12 as seen in FIG. 1, and for soldering to circuit traces on the board and/or in the holes.

Figure 6:
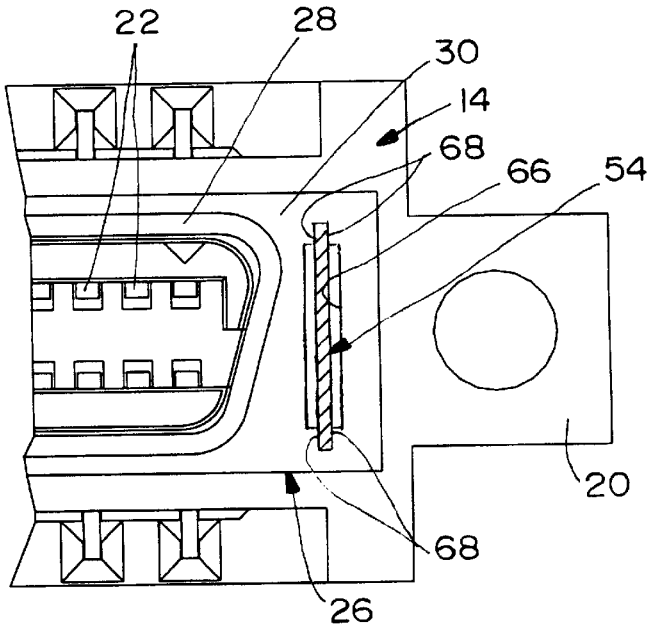
FIG. 6 is an enlarged, fragmented plan view of the area where one of the board locks extends through an aperture in the conductive shell.

A conductive shell, generally designated 26, is mounted on housing 10. The shell or shield includes a shroud portion 28 which generally surrounds mating face 16 of the connector housing and shields the interface area between terminals 22 and the terminals of the complementary mating connector. The shell has a flange 30 which projects from opposite ends of shroud 28 as best seen in FIG. 6 and as described hereinafter.

Figure 4:
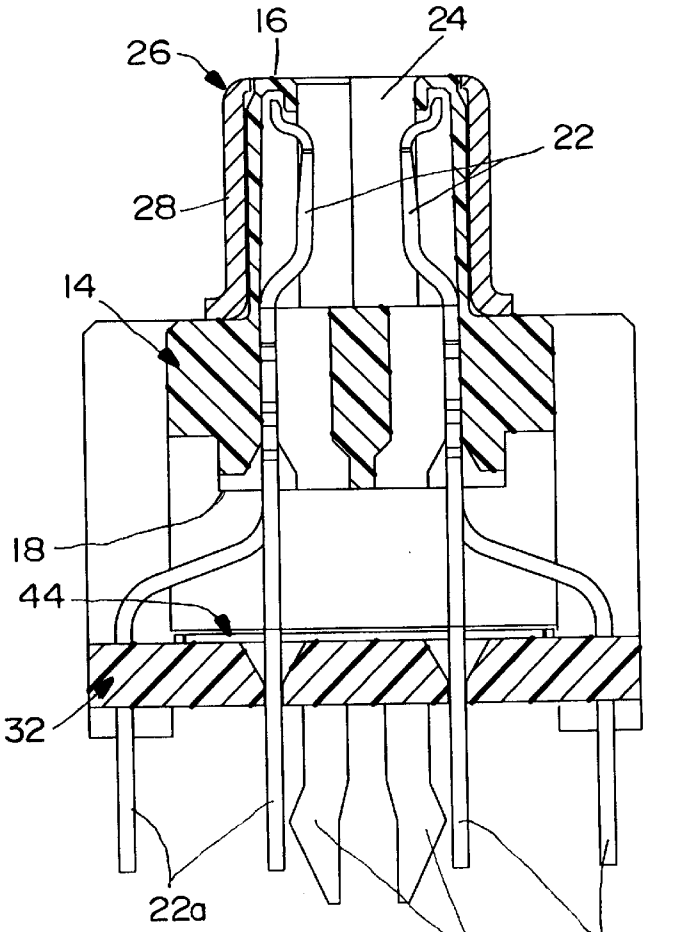
FIG. 4 is a vertical section taken generally along line 4—4 of FIG. 2.
Figure 5:
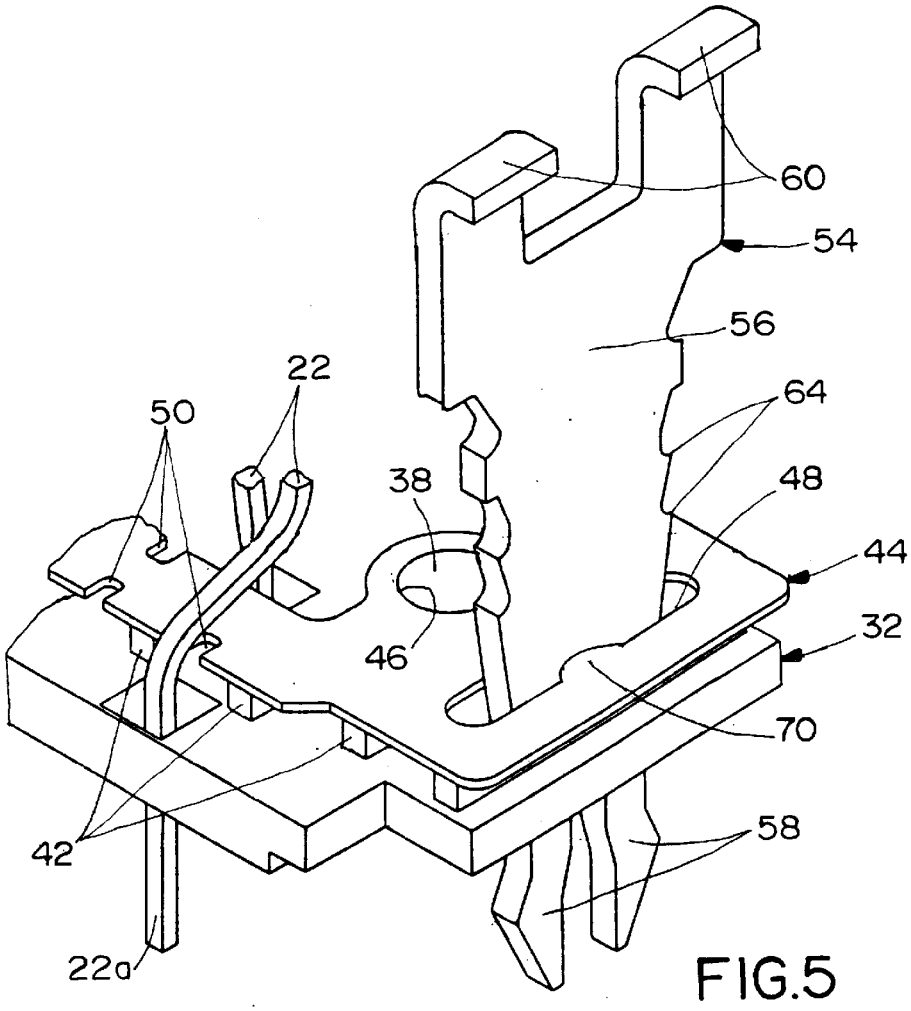
FIG. 5 is a fragmented perspective view of one of the board locks extending through apertures in the electrostatic discharge plate and the tail aligner.
Figure 8:
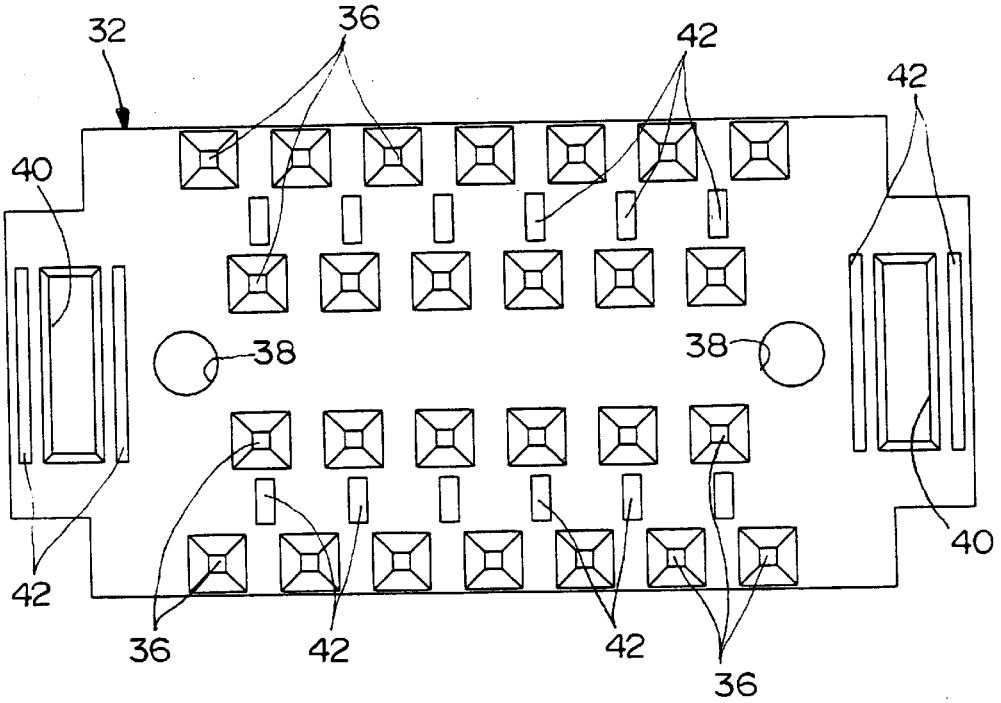
FIG. 8 is a plan view of the tail aligner.

Referring to FIGS. 5 and 8 in conjunction with FIGS. 1–4, the connector includes a dielectric or plastic terminal tail aligner, generally designated 32, which embraces solder tails 22*a*, with the tail aligner being disposed between a pair of depending legs 34 (FIG. 1) of housing 14. The bottom ends of legs 34 abut against the top of printed circuit board 12. Tail aligner 32 has four rows of passages 36 through which solder tails 22*a* of terminals 22 extend as best seen in FIGS. 1 and 4. The passages receive the solder tails and are effective in aligning the solder tails with premade and properly spaced holes in the printed circuit board. Referring specifically to FIG. 8, tail aligner 32 has a pair of longitudinally spaced posts 38 which project upwardly therefrom, a pair of longitudinally spaced apertures 40 and a plurality of upwardly projecting standoffs 42, all for purposes described hereinafter.

Figure 7:
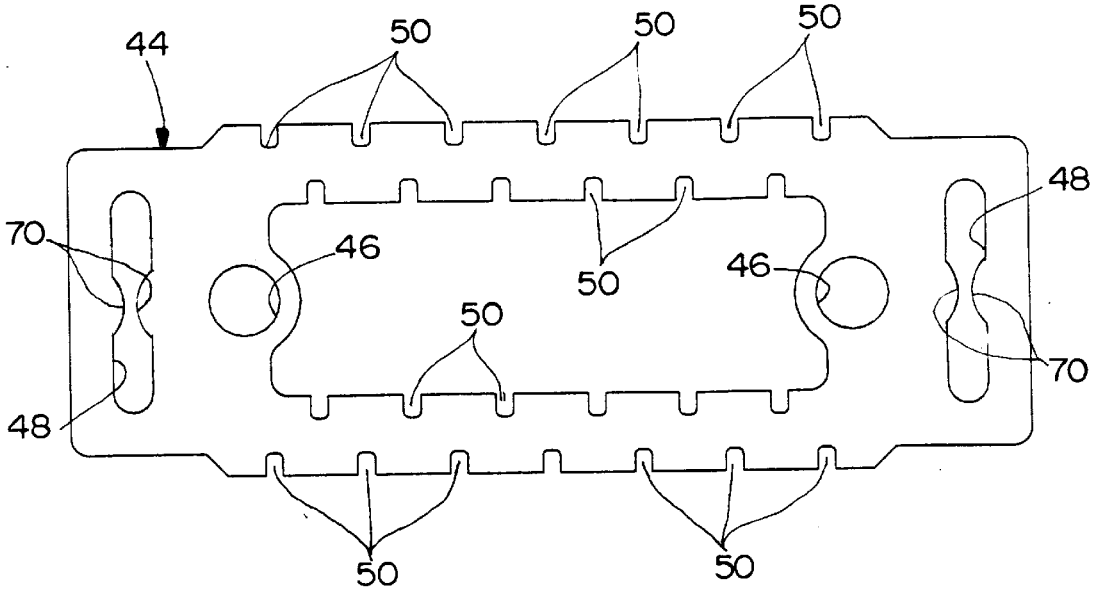
FIG. 7 is a plan view of the electrostatic discharge plate.

Referring to FIGS. 5 and 7 in conjunction with FIGS. 1–4, connector 10 includes a conductive electrostatic discharge plate 44 typically constructed of sheet metal material. The plate is mounted on top of tail aligner 32 as best seen in FIGS. 1 and 5. Specifically, the plate has a pair of longitudinally spaced holes 46 which receive upstanding posts 38 of the tail aligner to properly locate the electrostatic discharge plate in relation to the tail aligner and, in turn, to properly located the discharge plate relative to solder tails 22. The discharge plate rests on top of standoffs 42 which project upwardly from tail aligner 32. The plate has a pair of longitudinally spaced apertures 48 for purposes described hereinafter. Lastly, electrostatic discharge plate 44 includes a plurality of notches 50 in four linear edges thereof for alignment with the four rows of solder tails 22*a*. Each notch 50 defines a pair of corners which are at a predetermined spacing from solder tails 22*a* to create predetermined spark gaps between the plate and the solder tails to pass a current when a predetermined voltage exists between the plate and the solder tails of the terminals. Standoffs 42 space the discharge plate above the dielectric material of planar tail aligner 32 to significantly increase the spark area between the plate and the solder tails at notches 50. In other words, if the discharge plate 44 simply rested on top of the planar tail aligner 32, the dielectric material of the tail aligner would reduce the spark gap area at the edges of the plate on the side thereof which abuts the planar, dielectric tail aligner.

Figure 2:
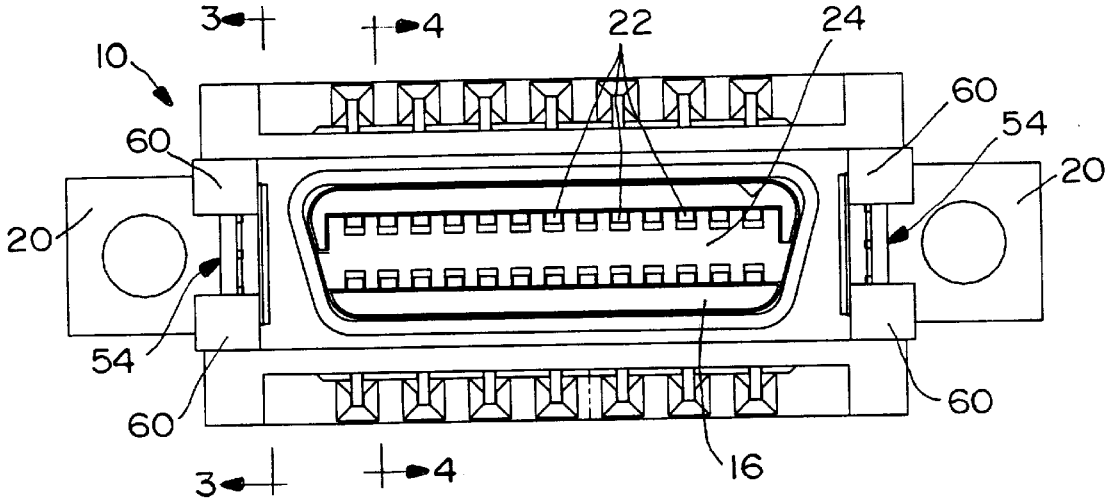
FIG. 2 is a top plan view of the connector in FIG. 1.
Figure 3:
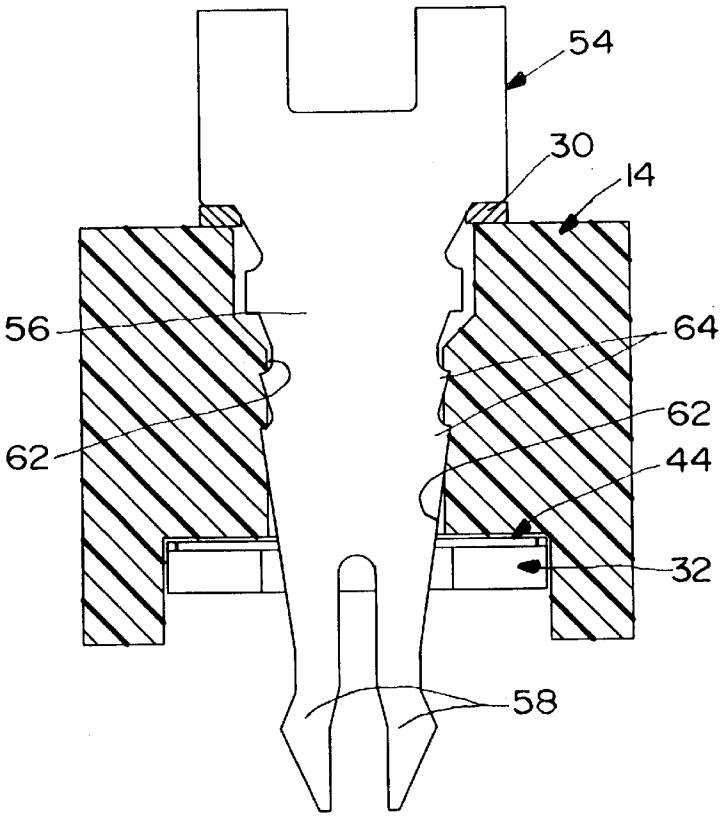
FIG. 3 is a vertical section taken along line 3—3 of FIG. 2.

FIG. 5 best shows the construction of one of a pair of conductive board locks, generally designated 54, which perform a multitude of functions in connector 10. Specifically, each board lock 54 is stamped and formed of conductive sheet metal material and includes a planar body portion 56 which is generally elongated to define a bifurcated board mounting end 58 and a pair of latch hooks 60 at the opposite end. The bifurcated board mounting end is adapted for insertion into a mounting hole in printed circuit board 12 to hold the connector to the printed circuit board. Hooked latches 60 are provided for latching the connector to the complementary mating connector. FIG. 3 best shows that connector housing 14 has an aperture 62 for each board lock 54. Planar body portion 56 of the board lock includes teeth 64 for establishing an interference fit with the connector housing within aperture 62. The connector is elongated and includes a pair of apertures 62 near opposite ends thereof for mounting a pair of board locks 54, as best seen in FIGS. 1 and 2.

FIG. 6 best shows that flange 30 of conductive shell 26 includes an aperture 66 for receiving one of the board locks 54 at each opposite end of the shell. Narrow portions 68 of aperture 66 extend inwardly of each aperture 66 for establishing a conductive interference fit between the conductive board lock and the conductive shell. Apertures 66 in shell 26 are aligned with apertures 62 in housing 14.

Board locks 54 pass through housing 14 and, as seen best in FIGS. 5 and 7, the board locks pass through apertures 48 in electrostatic discharge plate 44 and then through apertures 40 in tail aligner 32. Apertures 48 in the discharge plate are aligned with apertures 40 in the tail aligner which, in turn, are aligned with apertures 62 in housing 14 and apertures 66 in shell 26. Therefore, the board locks are inserted linearly downwardly through the entire series of apertures 66, 62, 48 and 40. Like apertures 66 in shell 26, apertures 48 in discharge plate 44 include a plurality of inwardly directed projections 70 which are effective to establish a conductive interference fit with board locks 54.

By connecting board locks 54 to a ground circuit on printed circuit board 12, it can be understood that the board locks are effective to common conductive shell 26 and conductive electrostatic discharge plate 44 with the ground circuit on the printed circuit board. From the foregoing, it also can be understood that each board lock 56 performs four distinct functions in connector 10, namely (1) mounting the connector to printed circuit board 12; (2) grounding shell 26 to the ground circuit on the printed circuit board; (3) grounding electrostatic discharge plate 44 to the ground circuit on the printed circuit board; (4) latching the connector to the complementary mating connector and (5) holding the grounding shell 26 to housing 14. By using a single member to perform all of these functions, the connector is made more efficiently, various separate functioning parts of prior connectors are eliminated, and valuable real estate is saved on the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mounting on a printed circuit board, comprising:

a dielectric housing having a front mating face and an opposite face;

a plurality of terminals mounted in the housing and including solder tails extending from the opposite face for connection to circuit traces on the printed circuit board;

a conductive shell mounted on the housing generally about the mating face;

a terminal tail aligner mounted to the housing and having a plurality of passages for receiving and aligning the solder tails of the terminals;

a conductive electrostatic discharge plate mounted on the tail aligner creating a predetermined spark gap between the plate and the solder tails to pass a current when a predetermined voltage exists between the plate and the solder tails; and a conductive board lock secured to the housing for holding the connector to the printed circuit board, the conductive board lock being adapted for connection to a ground circuit on the printed circuit board, and the board lock engaging the conductive shell and the conductive electrostatic discharge plate to common the shell and the plate with the ground circuit on the printed circuit board.

2. The electrical connector of claim 1 wherein said conductive board lock includes latch means adapted for latching the connector to an appropriate complementary mating connector.

3. The electrical connector of claim 1 wherein said conductive board lock passes through an aperture in the shell structured to establish an interference fit with the board lock.

4. The electrical connector of claim 1 wherein said conductive board lock passes through an aperture in the electrostatic discharge plate structured to establish an interference fit with the board lock.

5. The electrical connector of claim 4 wherein said conductive board lock passes through an aperture in the shell structured to establish an interference fit with the board lock.

6. The electrical connector of claim 1 wherein said conductive board lock passes through aligned apertures in the housing, the shell and the electrostatic discharge plate, with all of the apertures being structured to establish an interference fit with the board lock.

7. The electrical connector of claim 1 wherein said conductive board lock is elongated and includes a board mounting end for locking to the printed circuit board and a latch end adapted for latching to a complementary mating connector.

8. An electrical connector for mounting on a printed circuit board, comprising:

a dielectric housing including a mating portion;

a plurality of terminals mounted in the housing and including tail portions extending therefrom;

a conductive shell mounted on the housing generally about the mating portion thereof;

a conductive electrostatic discharge plate mounted about the tail portions of the terminals to create a predetermined spark gap between the plate and the tail portions to pass a current when a predetermined voltage exists between the plate and the tail portions; and a conductive board lock secured to the housing for holding the connector to the printed circuit board, the conductive board lock being adapted for connection to a ground circuit on the printed circuit board, and the board lock engaging the conductive shell and the conductive electrostatic discharge plate to common the shell and the plate with the ground circuit on the printed circuit board.

9. The electrical connector of claim 8 wherein said conductive board lock includes latch means adapted for latching the connector to an appropriate complementary mating connector.

10. The electrical connector of claim 8 wherein said conductive board lock passes through an aperture in the shell structured to establish an interference fit with the board lock.

11. The electrical connector of claim 8 wherein said conductive board lock passes through an aperture in the electrostatic discharge plate structured to establish an interference fit with the board lock.

12. The electrical connector of claim 11 wherein said conductive board lock passes through an aperture in the shell structured to establish an interference fit with the board lock.

13. The electrical connector of claim 8 wherein said conductive board lock passes through aligned apertures in the housing, the shell and the electrostatic discharge plate, with all of the apertures being structured to establish an interference fit with the board lock.

14. The electrical connector of claim 8 wherein said conductive board lock is elongated and includes a board mounting end for locking to the printed circuit board and a latch end adapted for latching to a complementary mating connector.

15. An electrical connector, comprising:

a dielectric housing;

a plurality of terminals mounted in the housing and including tail portions extending therefrom;

a terminal tail aligner mounted to the housing and having a plurality of passages for receiving and aligning the tail portions of the terminals;

a conductive electrostatic discharge plate mounted on the tail aligner creating a predetermined spark gap between the plate and the tail portions to pass a current when a predetermined voltage exists between the plate and the tail portions; and a plurality of standoffs projecting from the tail aligner into engagement with the electrostatic discharge plate to space the plate from the tail aligner and increase the spark area between the plate and the tail portions.

16. The electrical connector of claim 15 wherein said terminal tail aligner is fabricated of dielectric material and said electrostatic discharge plate is fabricated of sheet metal material.

17. The electrical connector of claim 16 wherein said electrostatic discharge plate includes an edge having notches adjacent to which the plurality of terminals are located.

* * * * *